US007896201B2

(12) United States Patent
Strobel-Schmidt

(10) Patent No.: US 7,896,201 B2
(45) Date of Patent: Mar. 1, 2011

(54) DISPENSING DEVICE

(75) Inventor: Rainer Strobel-Schmidt, Bad Woerishofen (DE)

(73) Assignee: Hilti Aktiengesellschaft, Schaan (LI)

( * ) Notice: Subject to any disclaimer, the term of this patent is extended or adjusted under 35 U.S.C. 154(b) by 690 days.

(21) Appl. No.: 11/999,132

(22) Filed: Dec. 3, 2007

(65) Prior Publication Data

US 2008/0142551 A1 Jun. 19, 2008

(30) Foreign Application Priority Data

Dec. 4, 2006 (DE) ..... 10 2006 035 476

(51) Int. Cl.
*B65D 88/54* (2006.01)

(52) U.S. Cl. ..... 222/333; 222/391; 222/326; 222/386

(58) Field of Classification Search ..... 222/333, 222/391, 326, 386
See application file for complete search history.

(56) References Cited

U.S. PATENT DOCUMENTS

| | | | | | |
|---|---|---|---|---|---|
| 2,367,346 | A * | 1/1945 | Good | 74/169 |
| 3,311,265 | A * | 3/1967 | Creighton, Jr. et al. | 222/137 |
| 4,171,072 | A * | 10/1979 | Davis, Jr. | 222/326 |
| 4,264,021 | A * | 4/1981 | Davis, Jr. | 222/326 |
| 4,273,269 | A * | 6/1981 | Davis, Jr. | 222/326 |
| 4,376,498 | A * | 3/1983 | Davis, Jr. | 222/326 |
| 4,566,610 | A * | 1/1986 | Herb | 222/137 |
| 5,192,008 | A * | 3/1993 | Hwan | 222/391 |
| 5,511,699 | A * | 4/1996 | Tepic | 222/326 |
| 5,595,327 | A * | 1/1997 | Dentler et al. | 222/327 |
| 5,871,354 | A * | 2/1999 | Kunkel et al. | 433/89 |
| 6,026,985 | A * | 2/2000 | Elliott, Sr. | 222/1 |
| 6,241,130 | B1 * | 6/2001 | Heiberger | 222/325 |
| 6,412,667 | B1 * | 7/2002 | Huang | 222/327 |
| 6,691,899 | B2 * | 2/2004 | Sung | 222/391 |
| 6,766,923 | B1 * | 7/2004 | Huang | 222/327 |
| 7,011,238 | B1 * | 3/2006 | Sung | 222/391 |
| 7,032,786 | B1 * | 4/2006 | Huang | 222/391 |
| 7,063,240 | B1 * | 6/2006 | Niswonger | 222/391 |
| 7,073,691 | B2 * | 7/2006 | Rumrill et al. | 222/391 |
| 7,306,125 | B2 * | 12/2007 | Takahashi et al. | 222/391 |
| 7,364,054 | B2 * | 4/2008 | Klein | 222/334 |
| 7,757,904 | B2 * | 7/2010 | Rumrill et al. | 222/391 |
| 7,784,648 | B2 * | 8/2010 | Hefele | 222/391 |
| 2005/0006414 | A1 * | 1/2005 | Tseng | 222/391 |
| 2007/0102457 | A1 * | 5/2007 | Campbell et al. | 222/333 |
| 2008/0179351 | A1 * | 7/2008 | Beckett | 222/391 |
| 2008/0197155 | A1 * | 8/2008 | Liang | 222/391 |
| 2009/0218372 | A1 * | 9/2009 | De Man et al. | 222/391 |

FOREIGN PATENT DOCUMENTS

| | | |
|---|---|---|
| EP | 1882 525 A2 | 1/2008 |
| FR | 2 763 007 | 11/1998 |

* cited by examiner

*Primary Examiner* — Kenneth Bomberg
*Assistant Examiner* — Donnell Long
(74) *Attorney, Agent, or Firm* — Abelman, Frayne & Schwab

(57) ABSTRACT

A dispensing device (11) for dispensing one-component or multi-component masses contained in vessels has a piston rod (21) and a forward feed mechanism (31). The forward feed mechanism (31) has a first clamping lever (32) and a second clamping lever (42) each of which is arranged on the piston rod (21) so as to be axially displaceable and swivelable in longitudinal direction (L) of the dispensing device (11). At least two spring elements (33, 43) act upon the clamping levers (32, 42). The device (11) further includes forward feed means for actuating the first clamping lever (32) and the second clamping lever (42) and having a first forward-feed element (34) cooperating with the first clamping lever (32) and a second forward-feed element (34) cooperating with the second clamping lever (42).

4 Claims, 3 Drawing Sheets

DISPENSING DEVICE

BACKGROUND OF THE INVENTION

1. Field of the Invention

The present invention relates to a dispensing device for dispensing one component or multi-component masses contained in vessels having at least one piston rod and at least one forward feed mechanism which has at least a first clamping lever and at least a second clamping lever, each of which is arranged on the piston rod so as to be axially displaceable and swivelable in longitudinal direction of the dispensing device. At least two spring elements are provided which act upon the clamping levers, and the at least one first clamping lever can be actuated by forward feed means of a driving mechanism.

2. Description of the Prior Art

A dispensing device of the type mentioned above for dispensing one-component or multi-component masses contained in vessels, e.g., foil bags or cartridges, is known from DE 198 50 495 A1, for example. This dispensing device has two piston rods on which first clamping levers for advancing the piston rods and second clamping levers for locking the piston rod are arranged. In dispensing devices, clamping levers of this kind are also called clamping pieces. A driving mechanism that includes a motor, is actuated by an actuation switch, and an eccentric cam, which serves as a forward feed device for the first clamping levers, rotates. The outer contour of the eccentric cam cooperates with the first clamping levers. As a result of the rotation of the eccentric cam, the first clamping levers are swiveled in longitudinal direction of the dispensing device, thereby pushing the piston rods forward. The second clamping levers form retaining clamping pieces and prevent a movement of the piston rods in a direction opposite the dispensing direction during the dispensing process. The clamping levers can be disengaged from the piston rod by means of an unlocking lever so that the piston rods can be moved into an initial position in which, for example, a new vessel can be placed in the dispensing device.

In contrast to dispensing devices having a lever mechanism acting on the first clamping levers as forward feed means, a contemporary dispensing device ensures a substantially improved dispensing of a constant amount of the mass to be dispensed every time the actuating switch is actuated.

One-component masses or multi-component masses are costly so that when using masses of this kind in chemically anchored dowels, for instance, an exact metering over the entire dispensing path of the dispensing device is desirable.

SUMMARY OF THE INVENTION

It is the object of the invention to provide a dispensing device for dispensing one-component masses or multi-component masses contained in vessels which improves the constancy of the amount of mass to be dispensed along the entire dispensing path.

This and other objects of the present invention, which will become apparent hereinafter, are achieved, according to the invention, by providing a dispensing device in which the forward feed means comprises a first forward-feed element cooperating with the at least one first clamping lever and a second forward-feed element cooperating with the at least one second clamping lever.

The first forward feed element actuates the at least one first clamping lever and the second forward feed element actuates the at least one second clamping lever. The forward feed elements are advantageously arranged on a drive shaft of the driving mechanism. Owing to the fact that the forward feed means is formed of multiple parts, the individual forward feed elements can be constructed and arranged in accordance with their cooperation with the clamping levers. Further, the multi-part construction facilitates manufacture of the forward feed means.

When the driving mechanism is actuated, the forward feed means of the forward feed mechanism acts directly or indirectly on the clamping levers so that a uniform forward feed of the corresponding piston rod is ensured, and a constant amount of the mass to be pressed out is accordingly dispensed along the entire dispensing path. Retaining clamping pieces such as those required in prior art dispensing devices which cause a high degree of wear are no longer needed in the dispensing device according to the invention.

The at least one second clamping lever can advantageously be actuated alternately with the at least one first clamping lever. In other words, the clamping levers are actuated by the forward feed means successively in time. For this purpose, the forward feed means has, for example, correspondingly arranged projections or control cams. At the start of the actuation of the at least one second clamping lever, the at least one first clamping lever is in its foremost swiveling position. As the actuation continues, the at least one second clamping lever is displaced by the forward feed means, and the at least one first clamping lever is swiveled back into its initial position again by the spring action of the first spring element. In the meantime, however, the at least one second clamping lever is already engaged with the at least one piston rod and pushes the latter forward. The at least one first clamping lever locks the at least one piston rod in its initial position so that the latter cannot move counter to its forward feed direction. When the at least one second clamping lever is in its foremost swiveling position, the at least one first clamping lever is actuated by the forward feed means with every further actuation of the dispensing device, and the at least one second clamping lever is relieved and is swiveled into its initial position by the second spring element which acts on this clamping lever counter to the dispensing direction. However, the at least one clamping lever is now already engaging with the at least one piston rod and moves the latter forward. The at least one second clamping lever now locks the at least one piston rod in the initial position so that the latter cannot move counter to its forward feed direction.

This advantageous forward feed means of a dispensing device has a particularly uniform force curve and accordingly ensures that a constant amount is pressed out over the entire dispensing path each time the dispensing device is actuated. The dispensing mechanism in its entirety is loaded uniformly so that the dispensing device according to the invention has a long useful life and a low susceptibility to mixing problems when dispensing, for example, multi-component masses.

The first forward feed element preferably comprises a first eccentric cam which can be set in rotation and whose outer contour cooperates with the at least one first clamping lever, and the second forward feed element comprises a second eccentric cam which can be set in rotation and whose outer contour cooperates with the second clamping lever, the first eccentric cam and the second eccentric cam are arranged on a driveshaft of the driving mechanism, and the eccentricity of the second eccentric cam is arranged so as to be offset by 180° to the eccentricity of the first eccentric cam. When the driving mechanism is actuated, the eccentric cams rotate. When the first eccentric cam acting on the at least one first clamping lever reaches the top dead center, it is in its foremost swiveling position, wherein the second eccentric cam already acts upon the at least one second clamping lever. As the eccentric cams continue to rotate, the at least one second clamping lever is swiveled by the second eccentric cam in longitudinal direction of the dispensing device against the force of the second spring element until it is in its foremost swiveling position. In this position, the first eccentric cam already acts upon the at least one first clamping lever. This advantageous forward feed mechanism of a dispensing device has a uniform force curve and accordingly ensures in a particularly advantageous manner that a constant amount is pressed out over the entire dispensing path each time the dispensing device is actuated. The dispensing mechanism in its entirety is loaded uniformly in an advantageous manner. The at least one first clamping lever is actuated by the eccentric cams uniformly or advantageously alternately with the at east one second clamping lever.

The angle from the top dead center of the eccentric cams to the start of the slope of one of the eccentric cams is preferably 25° to 50°. In particular, this angle is advantageously 30° to 40°. When one of the eccentric cams reaches the top dead center, the corresponding clamping lever is fully loaded and in its foremost swiveling position. Each of the eccentric cams advantageously has an eccentric projection which projects away from a circular shape and passes continuously from the start of the slope into the top dead center. Alternatively, the eccentric cams have a circular shape in outline, and their center is arranged eccentric to or at an offset to the driveshaft at the desired degree of eccentricity.

The length of the forward feed path which is traveled by the at least one piston rod each time the actuating switch is actuated depends upon the eccentricity and the magnitude of this eccentricity must be selected correspondingly. Therefore, the eccentric cams advantageously have an eccentricity of 0.5 mm to 10 mm. It is particularly advantageous when the eccentric cams have an eccentricity of 1.5 mm to 4 mm.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

Basically, identical parts are provided with the same reference numerals in the drawings.

DETAILED DESCRIPTION OF THE PREFERRED EMBODIMENTS

Figure 1:
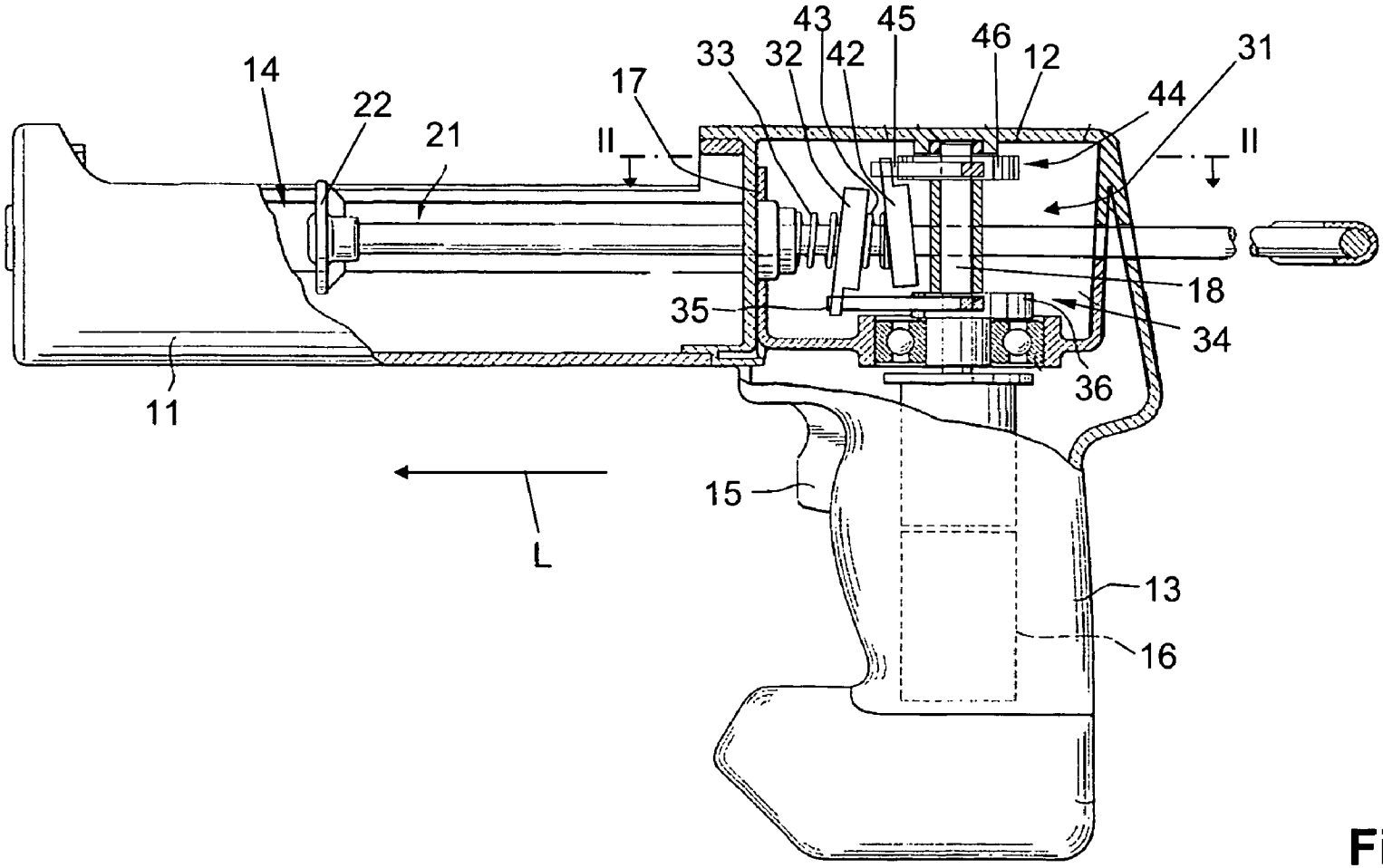
FIG. 1 a side partially cross-sectional view of a dispensing device according to the invention.

The dispensing device 11 shown in the drawings for dispensing multi-component masses contained in vessels such as foil bags or cartridges, for example, has a housing 12 with a handle 13 and a receptacle 14 for the vessel. A switch 15 by which a motor 16 can be switched on and off is provided at the handle 13.

The dispensing device 11 further has two piston rods 21 of a forward feed mechanism 31. A piston 22 for pressing out the multi-component mass is provided at the front end of the piston rods 21 in longitudinal direction L. The forward feed mechanism 31 has at each piston rod 21 a first clamping lever 32 and a second clamping lever 42 facing one another at an inclination to the longitudinal direction L. The clamping levers 32 and 42 are displaceable axially and swivelable in longitudinal direction L of the dispensing device 11. A helical compression spring is provided at the piston rods 21 in each instance as first spring element 33 acting upon the first clamping lever 32 between a housing portion 17 of an inner housing 19 and the first clamping levers 32. A helical compression spring is provided at the piston rods 21 in each instance between the first clamping lever 32 and the second clamping lever 42 as a second spring element 43 acting upon the second clamping lever 42.

The first clamping lever 32 and the second clamping lever 42 can be acted upon alternately by forward feed means of the driving mechanism. The forward feed means comprise a first forward feed element 34 and a second forward feed element 44. The first clamping levers 32 cooperate by means of a first forward feed plate 35 with the outer contour of a first eccentric cam 36 which can be set in rotation and which serves as the first forward feed element 34. The second clamping levers 42 cooperate by means of a second forward feed plate 45 with the outer contour of a second eccentric cam 46 which can be set in rotation and which serves as the second forward feed element 44. The two eccentric cams 36 and 46 are arranged on a driveshaft 18 driven by the motor 15. A spacer sleeve is advantageously provided so that the eccentric cams 36 and 46 are arranged at a distance from one another. The eccentric cams 36 and 46 advantageously roll on a counter-pressure bearing (not shown) that is secured to the forward feed plates 35 and 45, respectively, so that the friction between these elements is reduced and the usability of the dispensing device is substantially increased.

To guide the forward feed plate 35, this forward feed plate 35 has two guide projections 39 which are arranged opposite one another and supported in recesses 20 in the inner housing 19. To guide the forward feed plate 45, the forward feed plate 45 also has two guide projections 49 which are arranged opposite one another and supported in recesses 20 in the inner housing 19.

Figure 3:
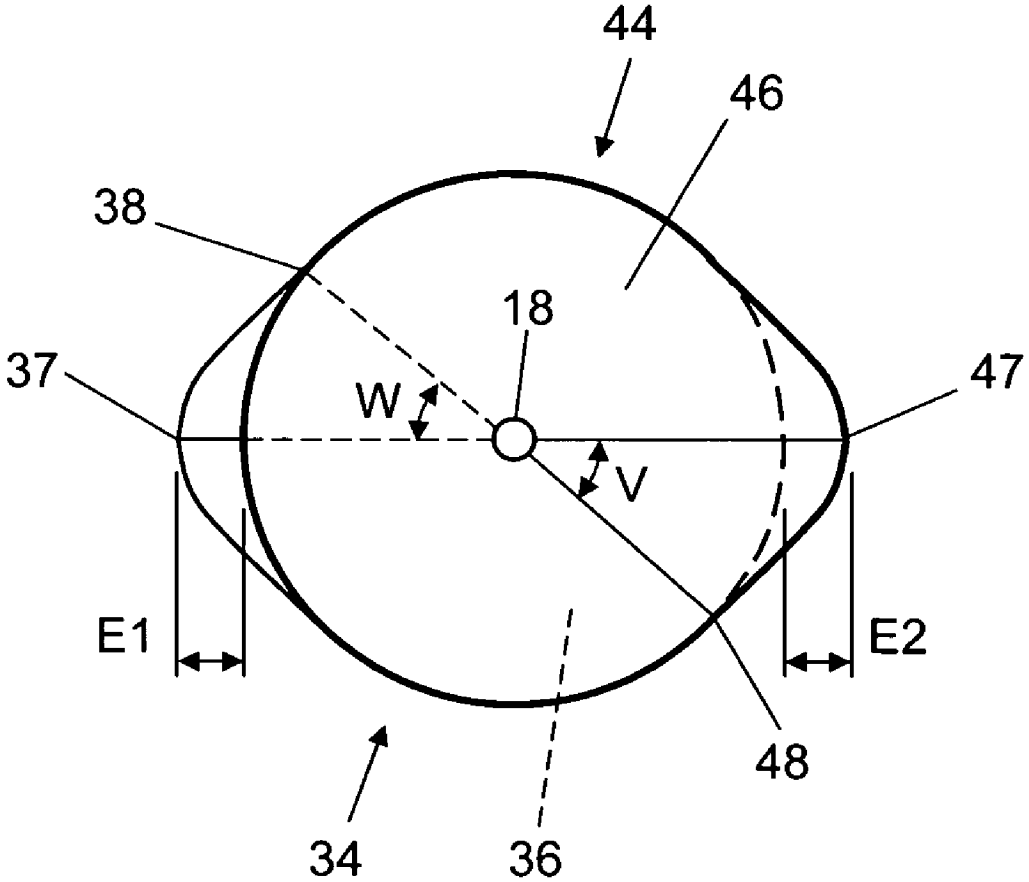
FIG. 3 an enlarged plan view of a detail of eccentric cams as forward feed elements.

As is shown particularly in FIG. 3, the eccentricity E2 of the second eccentric cam 46 is arranged so as to be offset by 180° relative to the eccentricity E1 of the first eccentric cam 36 so that the second clamping levers 42 are actuated alternately with the first clamping levers 32. The eccentricity E1 and E2 of the eccentric cams 36 and 46 determines the forward feed path S of the piston rods 21 and is 3 mm in this example. The angle W from the top dead center 37 to the start of the slope 38 of the first eccentric cam 36 and the angle V from the top dead center 47 to the start of the slope 48 of the first eccentric cam 46 is 35°, respectively.

Figure 2:
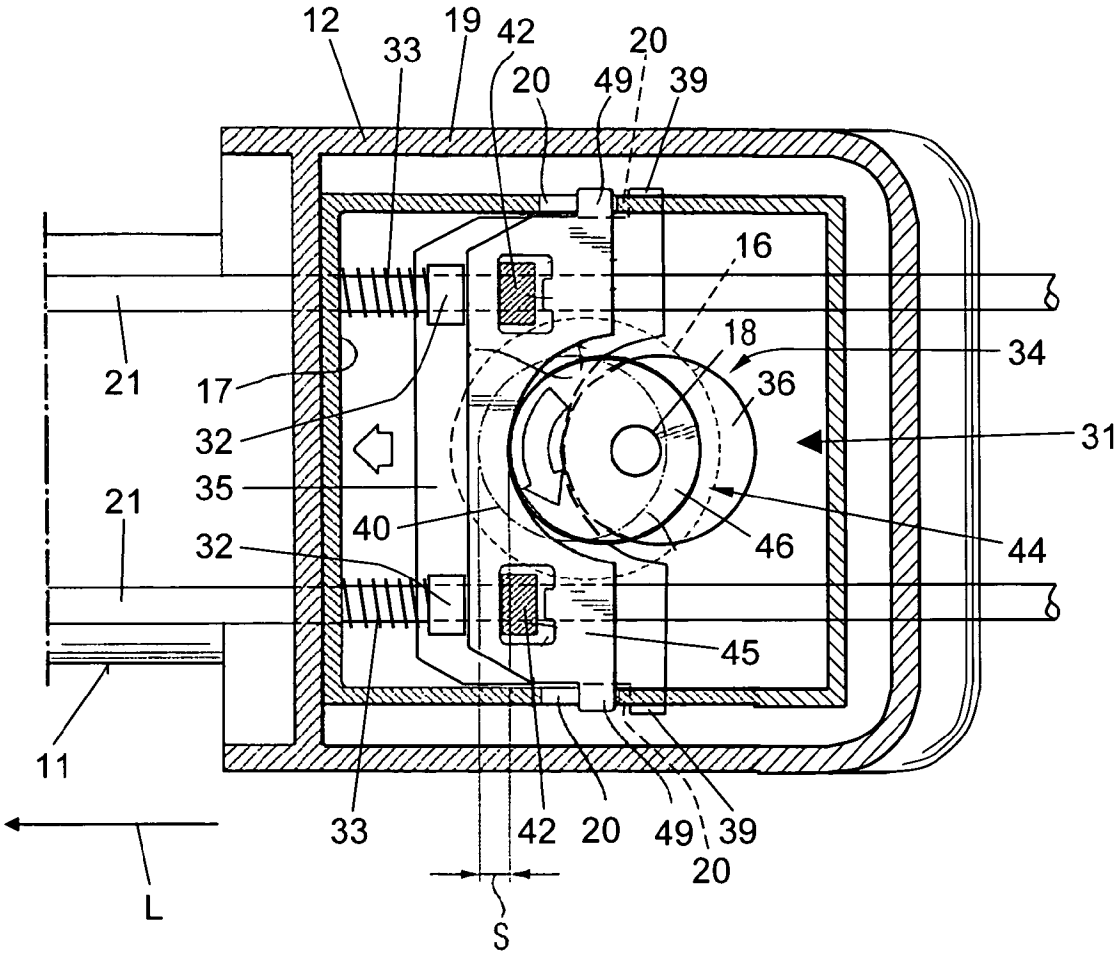
FIG. 2 a partial cross-sectional view along line II-II in FIG. 1.

FIG. 2 shows the forward feed mechanism 31 in the position of the forward feed elements 34 and 44, respectively, in which the eccentric cam 46 moves the second clamping lever 42 into the foremost swiveling position and the first eccentric cam 36 is in the remote position so that the first clamping levers 32 are in their initial position. To illustrate operation, the dash-dot line 40 schematically shows the position of the first eccentric cam 36 in which after the corresponding rotation of the eccentric cams 36 and 46 the first eccentric cam 36 has moved the first clamping lever 32 into its foremost swiveling position and the second clamping lever 42 would be in its initial position.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A dispensing device for dispensing one-component or multi-component masses contained in vessels, comprising at least one piston rod (21); at least one forward feed mechanism (31) having at least a first clamping lever (32) and at least one second clamping lever (42) each of which is arranged on the piston rod (21) so as to be axially displaceable and swivelable in longitudinal direction (L) of the dispensing device (11); at least two spring elements (33, 43) acting upon the at least one first clamping lever (32) and the at least one second clamping lever (42), respectively; and forward feed means for actuating the at least one first and second levers (32; 42) and having a first forward-feed element (34) cooperating with the at least one first clamping lever (32) and a second forward-feed element (34) cooperating with the at least one second clamping lever (42), wherein that the first forward feed element (34) comprises a first eccentric cam (36) which can be set in rotation and whose outer contour cooperates with the at least one first clamping lever (32), and the second forward feed element (44) comprises a second eccentric cam (46) which can be set in rotation and whose outer contour cooperates with the at least one second clamping lever (42), and wherein the first eccentric cam (36) and the second eccentric cam (46) are arranged on a driveshaft (18) of a driving mechanism, and eccentricity (E2) of the second eccentric cam (46) is arranged so as to be offset by 180° to eccentricity (E1) of the first eccentric cam (36).

2. A dispensing device according to claim 1, wherein an angle (W, V) from a top dead center (37, 47) of one of the eccentric cams (36, 46) to start of a slope (38, 48) of one of the eccentric cams (36, 46) is 25° to 50°.

3. A dispensing device according to claim 1, wherein eccentric cams (36, 46) have an eccentricity (E1, E2) of 0.5 mm to 10 mm.

4. A dispensing device according to claim 3, wherein the eccentric cams (36, 46) have an eccentricity (E1, E2) of 1.5 mm to 4 mm.

* * * * *